US006824025B1

(12) United States Patent
Ruble et al.

(10) Patent No.: US 6,824,025 B1
(45) Date of Patent: Nov. 30, 2004

(54) PIVOTAL DISPENSING NOZZLE WITH DIVERTER SPRAY VALVE

(75) Inventors: Steve B. Ruble, Lexington, KY (US); Richard J. Baumgart, Paris, KY (US); Zhiqiang Zhang, Lexington, KY (US)

(73) Assignee: Ashland INC, Lexington, KY (US)

( * ) Notice: Subject to any disclaimer, the term of this patent is extended or adjusted under 35 U.S.C. 154(b) by 0 days.

(21) Appl. No.: 10/350,161

(22) Filed: Jan. 23, 2003

(51) Int. Cl.[7] ..... B67D 3/00; A62C 5/02

(52) U.S. Cl. ..... 222/527; 222/402.1; 222/402.13; 222/402.17; 239/310; 264/293; 137/625.48

(58) Field of Search ..... 222/527, 529, 222/575, 567, 402.1, 402.17, 402.25, 399, 402.13, 402.11, 182; 239/344, 396, 310; 137/625.48; 264/293, 263

(56) References Cited

U.S. PATENT DOCUMENTS

| | | | | | |
|---|---|---|---|---|---|
| 1,377,922 | A | * | 5/1921 | Posa | 222/399 |
| 2,038,349 | A | | 4/1936 | Diesbourg | |
| 2,372,154 | A | | 3/1945 | Ahern | |
| 2,824,672 | A | | 2/1958 | Wersching | |
| 2,908,446 | A | * | 10/1959 | Strouse | 222/402.1 |
| 3,116,856 | A | | 1/1964 | Prussin et al. | |
| 3,148,806 | A | | 9/1964 | Meshberg | |
| 3,189,232 | A | * | 6/1965 | Joffe | 222/402.13 |
| 3,221,950 | A | * | 12/1965 | O'Donnell | 222/402.11 |
| 3,242,828 | A | | 3/1966 | Larkin | |
| 3,402,741 | A | | 9/1968 | Yurdin | 222/527 |
| 3,409,224 | A | * | 11/1968 | Harp et al. | 239/33 |
| 3,641,884 | A | * | 2/1972 | Jivoin | 264/293 |
| 3,878,976 | A | | 4/1975 | Giuffredi | 222/402.13 |
| 4,141,477 | A | | 2/1979 | Hengesbach | 222/527 |
| 4,278,188 | A | | 7/1981 | Stephenson et al. | |
| 4,305,528 | A | * | 12/1981 | Craig | 222/182 |
| 4,650,470 | A | * | 3/1987 | Epstein | 239/310 |
| 4,664,300 | A | * | 5/1987 | Strickland | 222/402.13 |
| 4,858,792 | A | | 8/1989 | de Laforcade | |
| 4,865,230 | A | | 9/1989 | Tugwood | |
| 5,058,783 | A | | 10/1991 | Antonelli | |
| 5,143,263 | A | | 9/1992 | Newell | 222/402.1 |
| 5,271,538 | A | | 12/1993 | Lipker et al. | |
| 5,421,519 | A | | 6/1995 | Woods | 222/402.17 |
| 5,505,344 | A | | 4/1996 | Woods | |
| 5,529,226 | A | | 6/1996 | Alberth, Jr. | 222/402.1 |
| D396,410 | S | | 7/1998 | Gault | D9/434 |
| 5,890,631 | A | * | 4/1999 | Spurlock et al. | 222/182 |
| 5,918,776 | A | | 7/1999 | Atkinson | |
| 5,988,575 | A | | 11/1999 | Lesko | |
| 5,992,702 | A | | 11/1999 | Shapiro | |
| 6,105,826 | A | | 8/2000 | Oursin et al. | |
| 6,497,836 | B2 | * | 12/2002 | Krause et al. | 264/263 |

OTHER PUBLICATIONS

An Italian Company Reportedly Invented The Direction Nozzle Shown In The Instant Application S.N. 10/350,161 Figures (1–5). It May Be Under The Name Of Costor Technologie Special: SPA in Milan, Italy. A Company Supplying The Nozzle Shown In Figs 1–5 & Labeled Prior Art Is: Seaquist Perfect Dispensing, 1160 North Silver Lake Road, Gary, IL 60013.

US 2002/0053579 A1 by Baumgart et. al. for "Container Cap With Pivoting Dispensing Nozzle" Published May 9, 2002.

* cited by examiner

*Primary Examiner*—Thai-Ba Trieu
(74) *Attorney, Agent, or Firm*—Carrithers Law Office; David W. Carrithers

(57) ABSTRACT

An adjustable dispensing nozzle for an aerosol container in which pivotally interconnected elbows have an extension tube extending from one elbow and a stem on the other elbow inserted into and pivotal in a socket on a valve actuating lever of a cap mounted on the container. The elbow has a diverter valve rotatably mounted in the cylindrical body for directing the contents of the container to an orifice to exit as a spray, or to a socket in which an extension tube can be inserted to deliver the contents to a selected target as a stream.

4 Claims, 8 Drawing Sheets

PIVOTAL DISPENSING NOZZLE WITH DIVERTER SPRAY VALVE

FIELD OF INVENTION

This invention relates generally to aerosols (including aerogels) and more particularly to a flexible directional applicator tube extendable from a dispensing nozzle that of the container cap of a pressurized aerosol or foam container including a product under pressure in a container and a cap on the container.

BACKGROUND OF INVENTION

There are numerous aerosol products (fine spray mixture) and aerogels (foams) in use today and only to mention a few they include insecticides, lubricants, paints and other coating materials, hair fixatives, shaving cream, whipped cream etc. In most all instances the contents of the pressurized container issue from an orifice in a head piece mounted on a tubular valve stem or from a tube that is insertable into a recess in the head piece that extends toward the orifice. This works well for most products with generalized targets but specific targets are often difficult if not impossible to reach. For example in applying lubricants or cleaners to specific targets the presently available dispensing means are not suitable.

There are numerous devices commercially available to apply a stream or a liquid or a spray of liquid onto a surface to be treated. For instance, Seaquist Perfect Dispensing Company located in Cary, Ill., sales an adjustable dispensing nozzle for an aerosol container having a pivotally connecting extension. However, none of the prior art devices commercially available incorporate a diverter valve device for delivery of a spray or stream of product through a pivotal extension.

SUMMARY OF INVENTION

The present invention is an adjustable dispensing nozzle for an aerosol container in which pivotally interconnected elbows have an extension tube extending from one elbow and a stem on the other elbow inserted into and pivotal in a socket on a valve actuating lever of a cap mounted on the container. The elbow includes a diverter valve rotatably mounted therein for directing the contents of the aerosol thorough a tube as a stream or alternately through an orifice as a spray.

More particularly, the present invention defines an adjustable dispensing nozzle for an aerosol container comprising a cap having a top wall, an annular lower wall portion mountable on an aerosol container and a valve actuating lever for depressing a tubular valve stem on the aerosol container. The valve actuating lever having a passageway communicating at one end thereof with the passageway of said tubular valve stem and at the other end with a first socket in an outer face surface of said cap. The cap includes a first elbow having a stem inserted into and rotatable in said first socket, a second elbow rotatably connected to said first elbow and an extension tube connected to said second elbow. The elbow has a diverter valve rotatably mounted in the cylindrical body for directing the contents of the container to one or the other of an orifice to exit as a spray or the socket in which the extension tube can be inserted to deliver the contents to a selected target as a stream.

A principal object of the present invention is to provide a pivotally movable aerosol dispensing nozzle.

A further principal object of the present invention is to provide a cap for an aerosol container and wherein the cap has a dispensing nozzle pivotally mounted thereon.

Another object of the present invention is to provide a cap having a nozzle pivotally mounted thereon with a means for producing a mist in a conical, flat spray pattern, or stream.

Another object of the present invention is to provide a dispensing nozzle having a removable, resemble, and extendible applicator straw including one or more bendable joint for directing and applying a stream of liquid around an object, wherein the joint allows a portion of the straw to remain bent at a selected angle until repositioned by the user.

These and other objects of the present invention will be more fully understood from the following description of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
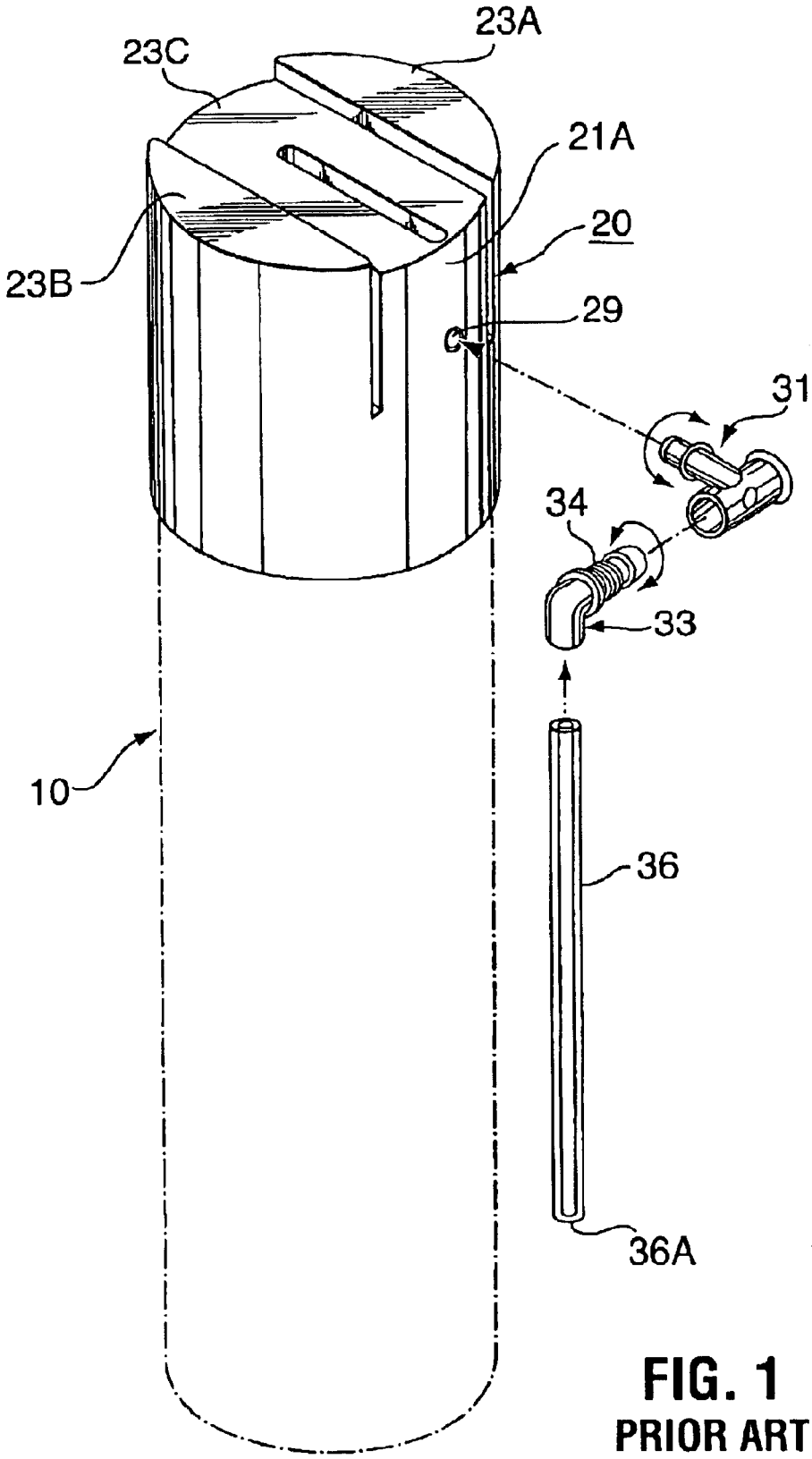
FIG. 1 PRIOR ART
FIG. 1 is an exploded perspective view of a commercially available prior art aerosol dispensing container cap sold by Seaquest Perfect provided in accordance with the present invention with a pivotally mounted dispensing nozzle.
Figure 2:
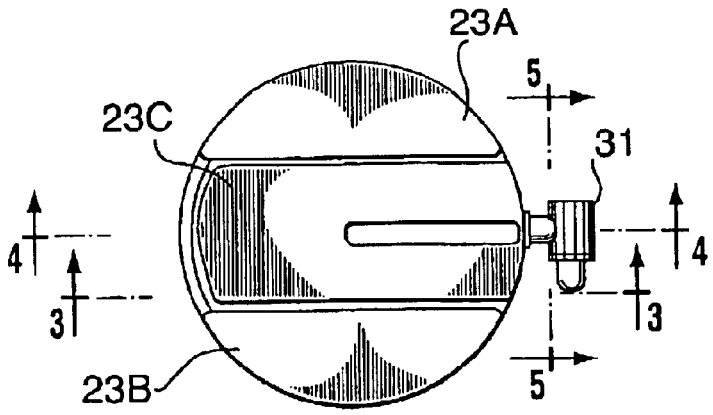
FIG. 2 PRIOR ART
FIG. 2 is a top plan view of the assembled prior art aerosol dispensing cap of FIG. 1.
Figure 3:
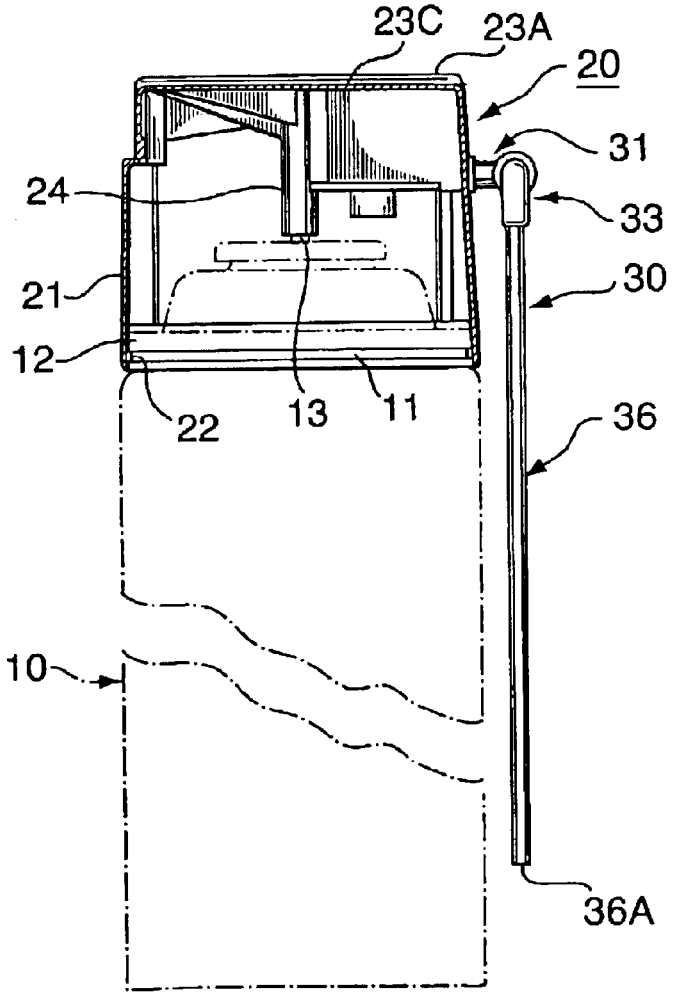
FIG. 3 PRIOR ART
FIG. 3 is a sectional view taken along line 3—3 of the prior art aerosol dispensing cap of FIG. 2.
Figure 4:
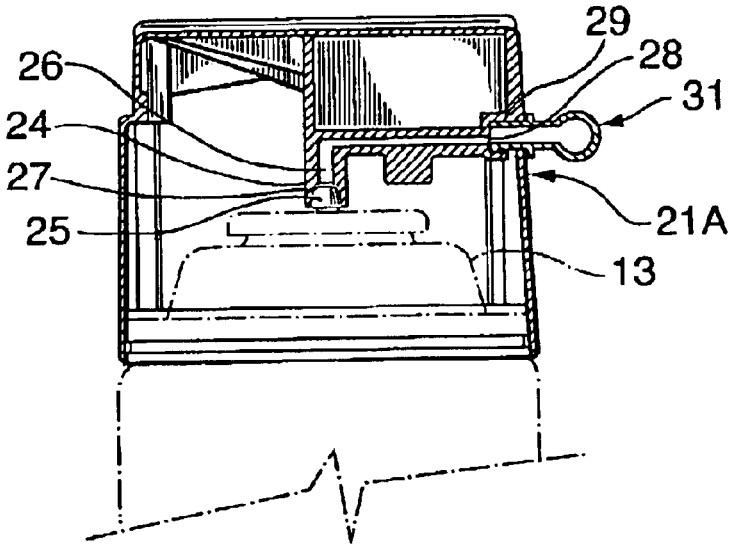
FIG. 4 PRIOR ART
FIG. 4 is a sectional view taken along line 4—4 of the prior art aerosol dispensing cap of FIG. 2.

Referring to the drawings, there is illustrated an aerosol container 10, a dispensing cap 20 mounted on the container and a dispensing nozzle 30 pivotally mounted on the cap 20. The cap 20 has an a cylindrical wall 21 with a rib 22 on the internal surface of the lower end thereof that snap fits into a groove 11 in a lip 12 on the upper end of the container. The cap further has a top wall comprising outer segments 23A, 23B and a valve actuating lever portion 23C disposed there between. The lever portion 23C includes a segmental portion 21A of the side wall and is canter levered therefrom extending in a direction toward a diametrically opposite portion of the side wall.

The valve actuating lever portion 23C of the top wall has a stem 24 projecting downwardly from the underside thereof. A recess 25 in the bottom end of the stem 24 slip fits onto a conventional hollow valve stem 13 that projects upwardly from the center of the top of the aerosol container. The stem 24 has a passageway 26 that is smaller in diameter than the recess 25 thus providing a shoulder 27 to butt against the top end of the valve stem.

The passage 26 changes direction (90 degrees) and continues into a spigot portion 28 that projects into a circular recess 29 forming a first socket in the side wall segment 21A of the top 20. The pivotally mounted dispensing nozzle 30 includes a first elbow 31 having a stem 32 that press fits into the recess 29 in the cap and is rotatable therein, a second elbow 33 having a stem 34 that press fits into a socket 35 in the first elbow 31 and is rotatable therein and an extension tube 36 having an end portion that press fits into a portion 37 of the second elbow 33.

Figure 5:
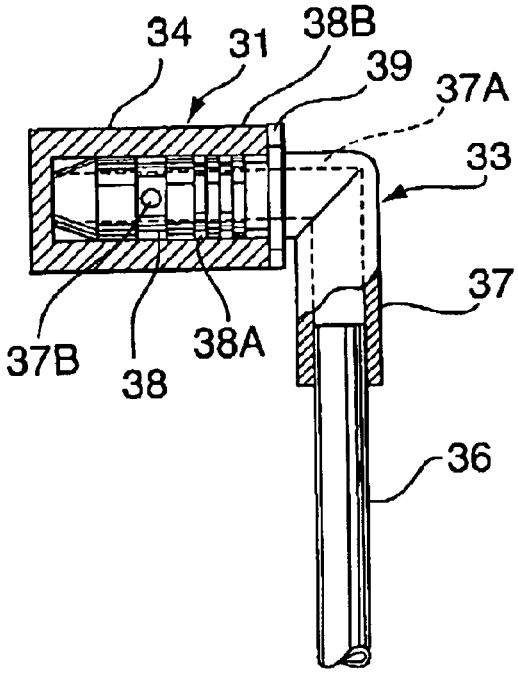
FIG. 5 PRIOR ART
FIG. 5 is a sectional view taken along line 5—5 of the prior art aerosol dispensing cap of FIG. 2.

The stem 34 of the second elbow 33 has an annular groove 38 that is in alignment with the flow passage in the stem 32 of the first elbow 31 when fully inserted into the recess. This relative positioning is predetermined by a flange 39 on the second elbow 33 that abuts the first elbow 31 and/or engagement of the stem with the bottom end of the recess 35 as best illustrated in FIG. 5.

The second elbow 33 has a flow through passage 37A that communicates with an aperture 37B located in the groove 38. There are two further grooves designated respectively 38A and 38B in the stem 34 for receiving O-ring seals if so desired. The stem 32 of first elbow 31 has an O-ring seal 32A. Suitable grooving can be provided in the receptors to maintain assembly of the components particularly when intended for use in dispensing aerogels.

The first elbow 31 can be rotated 360 degrees about the axis of stem 32 and the second elbow 33 can be rotated at least 180 degrees about the axis of the stem 34. This pivotal movement about the two mutually perpendicular axes permits variously positioning the discharge end 36A of the tube 36 to deliver the contents to specific hard to otherwise get at targets.

Figure 6:
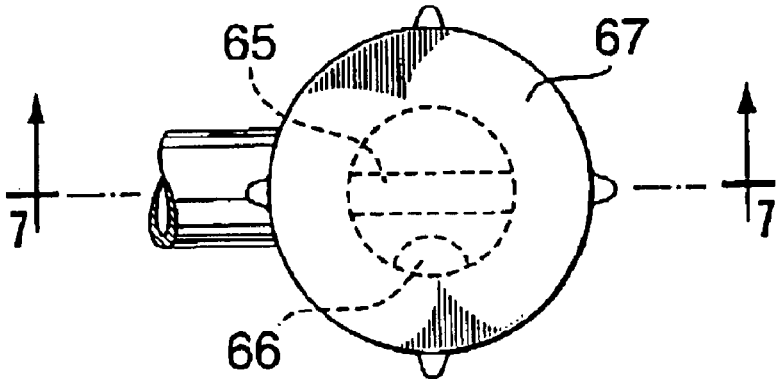
FIG. 6 is a horizontal sectional view of a diverter valve of the present invention showing a valve stem having a passageway that extends through the stem (transverse to the length thereof) and a groove or channel in the outer surface of and extending lengthwise of the stem.
Figure 7:
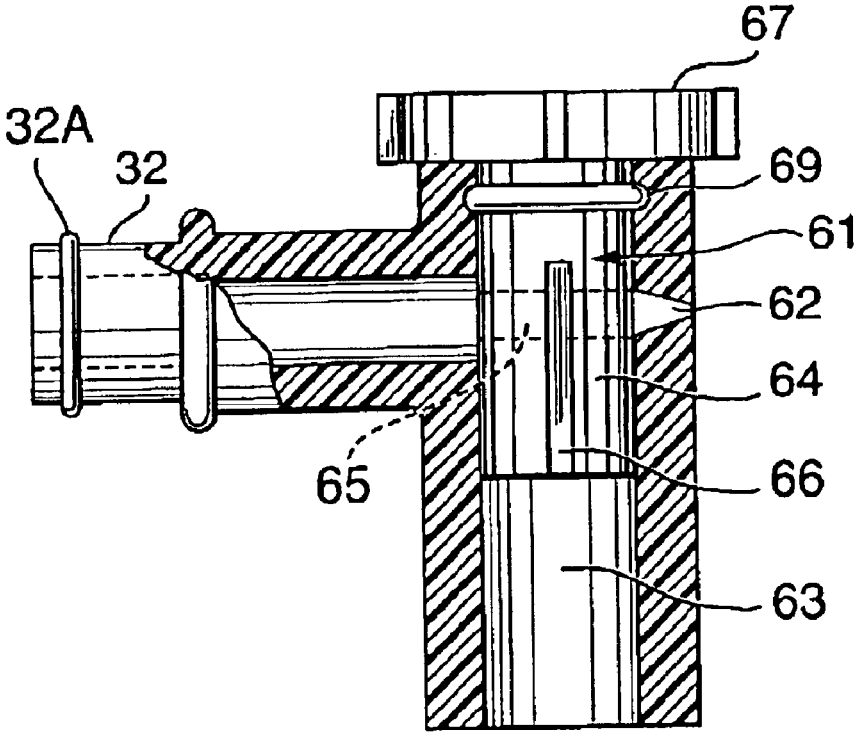
FIG. 7 is a side or vertical sectional view of the embodiment of the present invention of FIG. 6.
Figure 8:
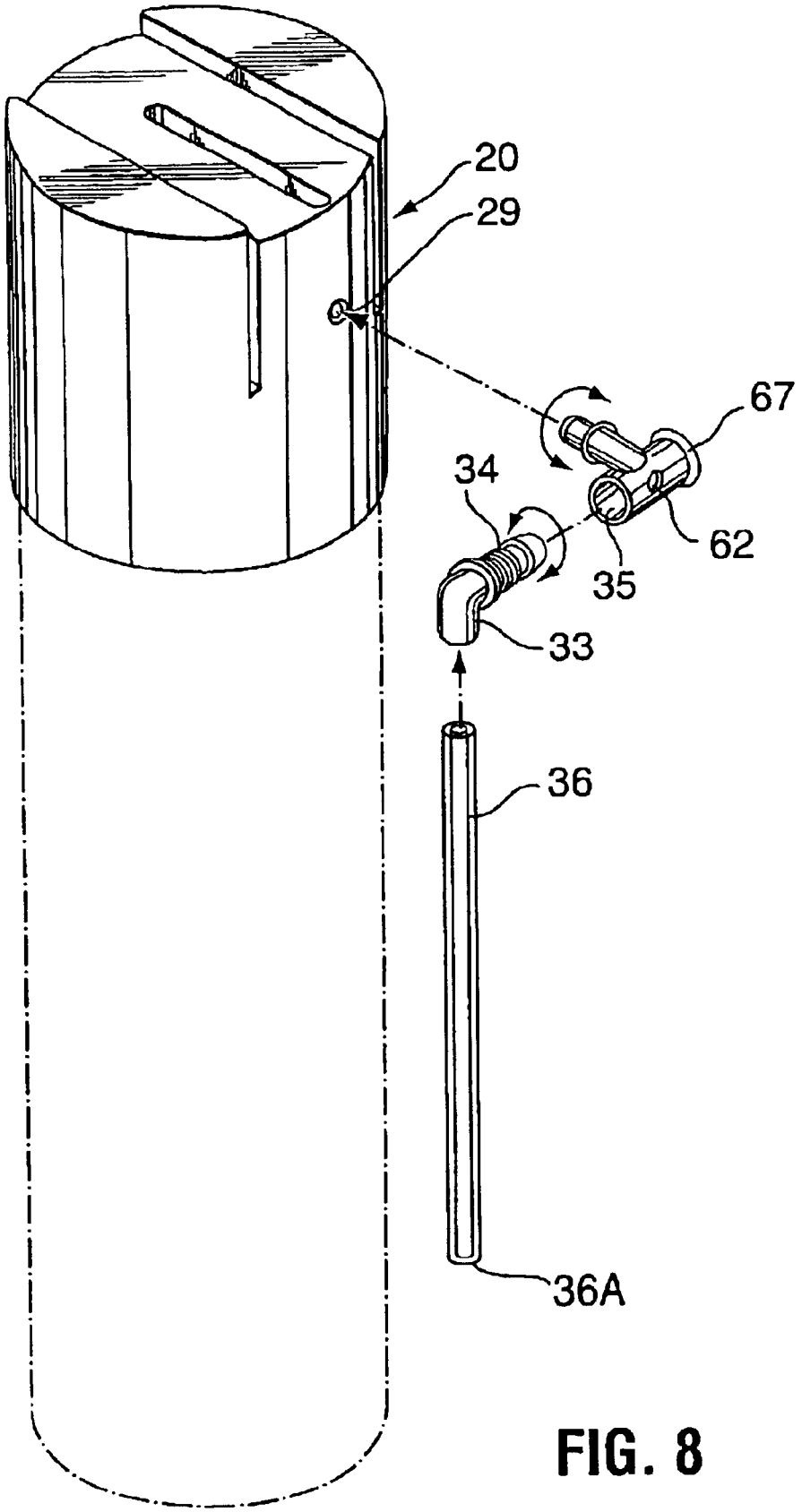
FIG. 8 is a perspective view of the present invention showing an aerosol dispensing cap with a pivotal nozzle including the diverter valve shown in FIGS. 6 and 7.
Figure 9:
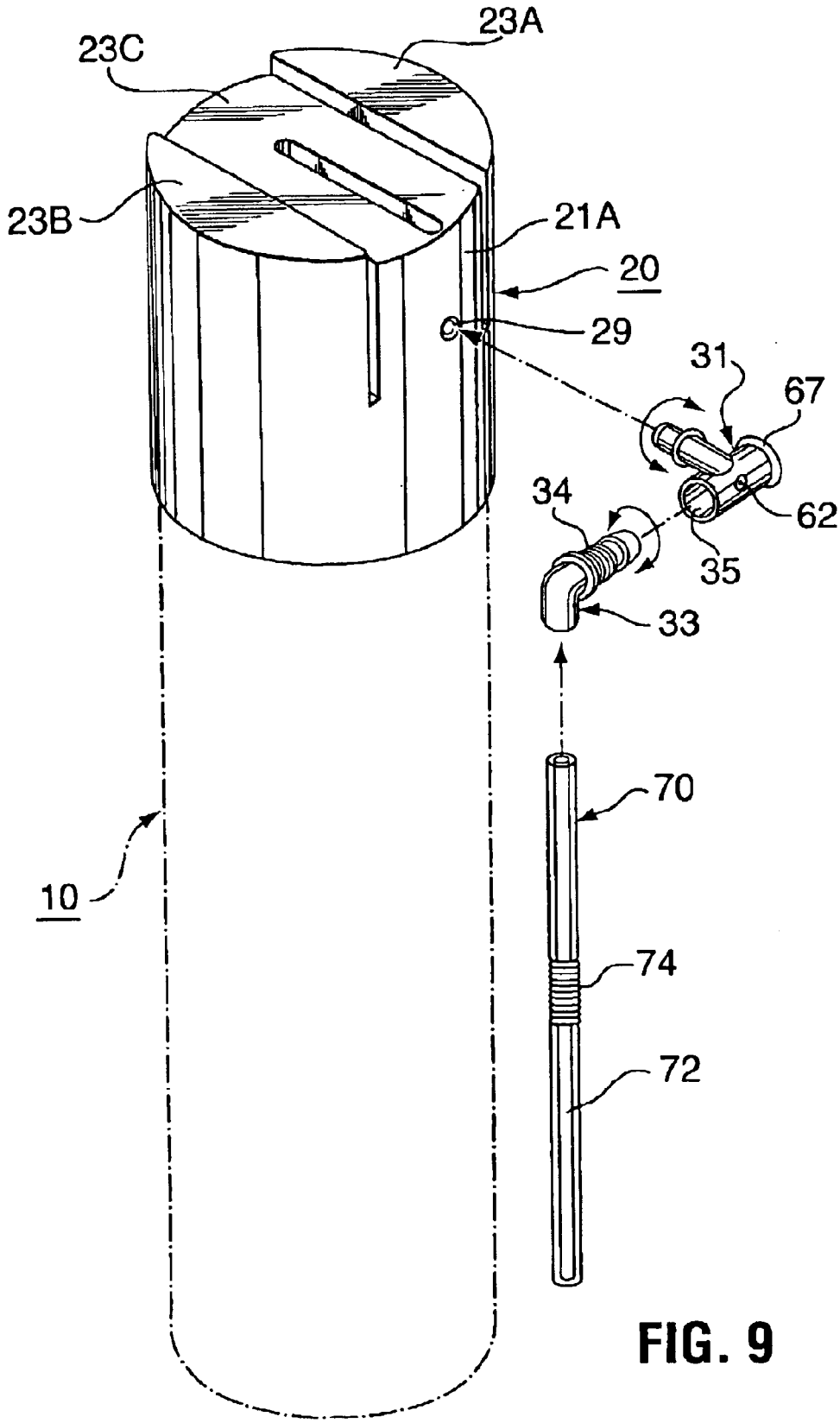
FIG. 9 is perspective view of the present invention showing a pivotally mounted dispensing nozzle with a diverter valve including a flexible directional applicator tube with a corrugated section for bending.
Figure 10:
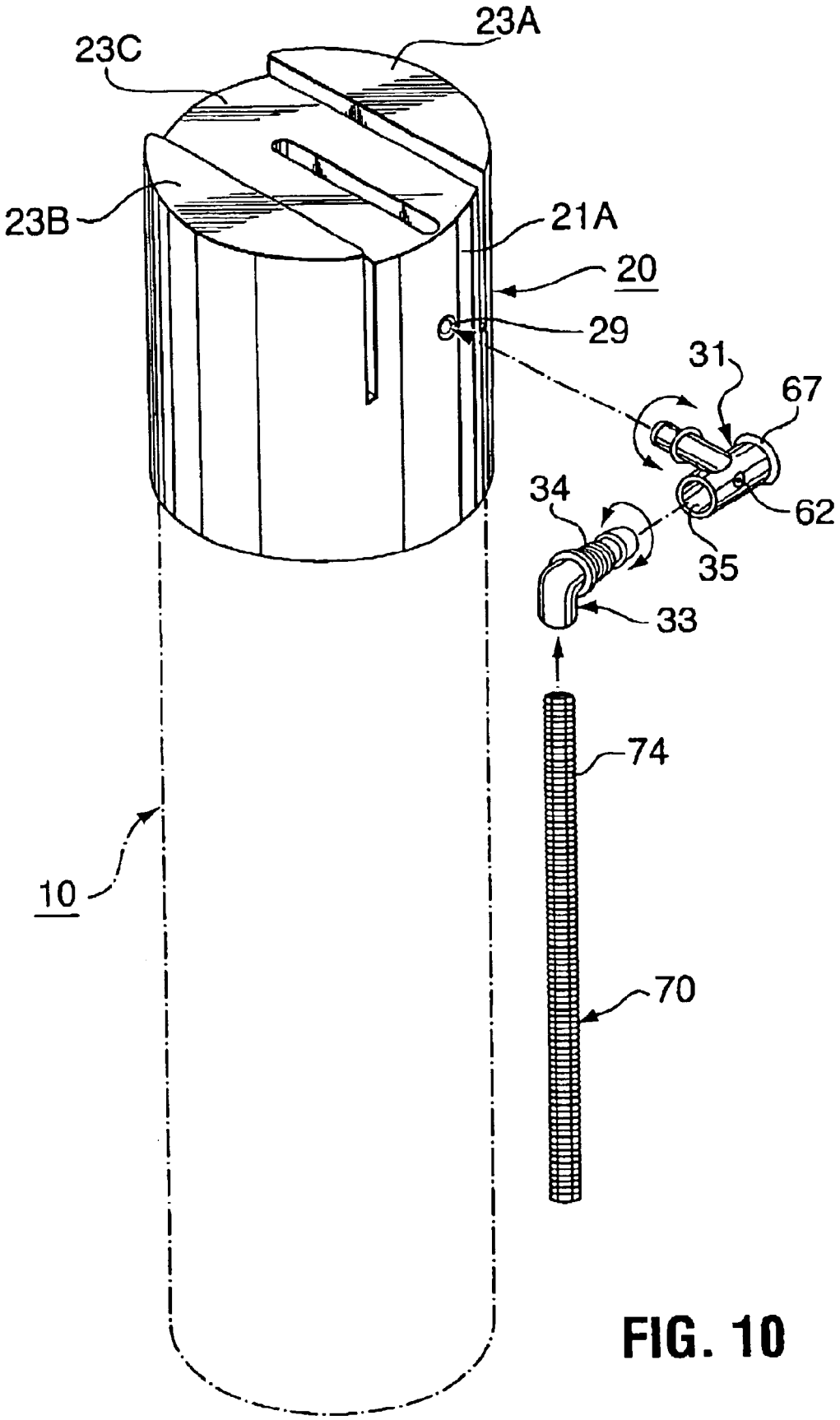
FIG. 10 is a perspective view of the present invention showing a pivotally mounted dispensing nozzle with a diverter valve including a corrugated extension.
Figure 11:
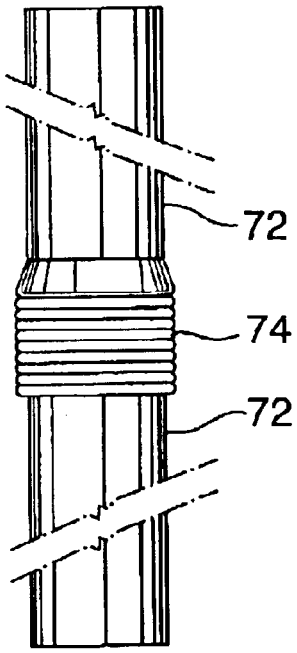
FIG. 11 is a perspective view of the present invention showing a collapsed portion of the corrugated extension utilizing a section of corrugated tubing as shown in FIGS. 9 and 10.
Figure 12:
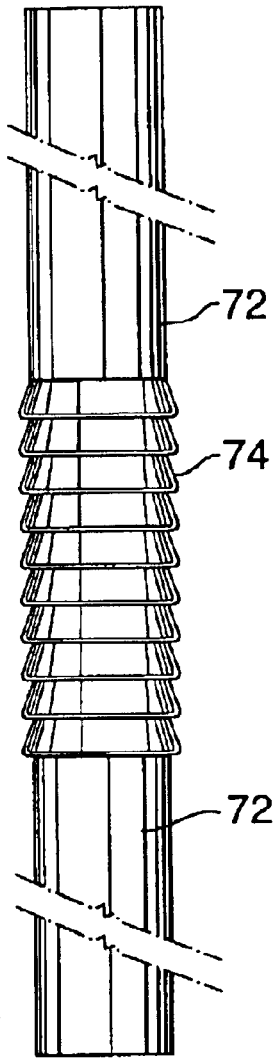
FIG. 12 is an enlarged sectional view of a corrugated portion of the corrugated section of the extension showing the folds are unidirectional and overlapping.
Figure 13:
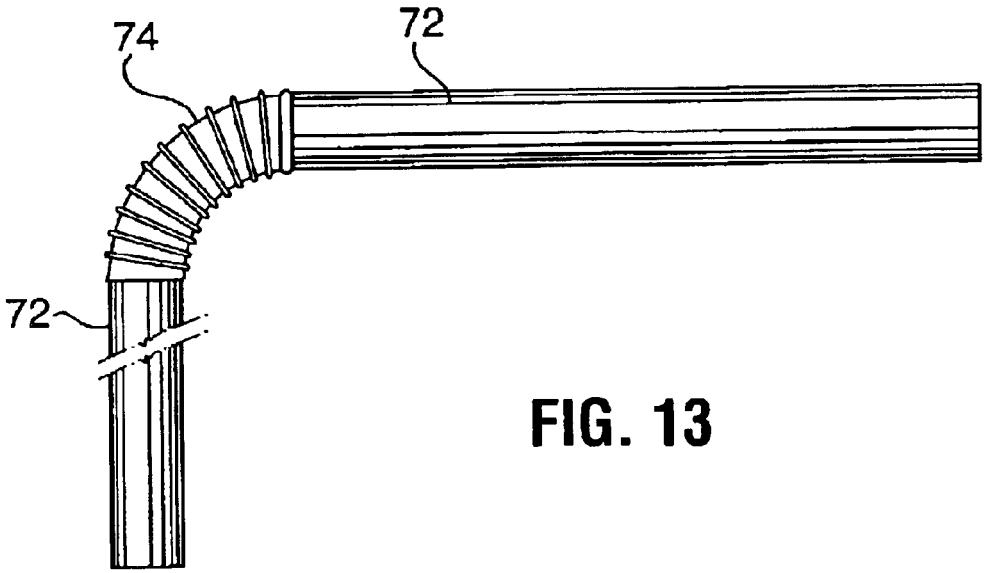
FIG. 13 is an enlarged side elevational views of the corrugated portion of FIG. 12 wherein the extension is bent at a right angle to show the compression of the unidirectional overlapping folds along the interior portion of the tube at the bend and the unidirectional overlapping folds extending along the exterior portion of the tube.

As best illustrated in FIGS. 6 and 7, the present invention encompasses an improvement to the prior art pivotal dispensing nozzle shown in FIGS. 1–5, utilizing an alternate embodiment elbow 60 for use as an alternative to the previously described elbow 31. The elbow 60 has a diverter valve 61 rotatably mounted in the cylindrical body for directing the contents of the container to one or the other of an orifice 62 and a socket 63 in which the extension tube 36 can be inserted. The orifice can simply be a round hole or an opening having a particular shape such as round, oval, square, triangular, or formed in the shape of a slit to provide a desired type of spray pattern. Moreover, the opening may be counterbored or formed having a conical shape to effect a spray pattern.

The diverter valve comprises a valve stem 64 having a passageway 65 that extends through the stem (transverse to the length thereof) forming a throughbore and a groove or channel 66 in the outer surface of and extending lengthwise of the stem.

The stem is rotatable in the cylindrical body and can be turned from one position to the other of in one position aligning the passage through elbow stem 32 with the orifice 62 via passage 65 in the stem and in the other position providing communication between the passage in the elbow stem 32 and the socket 63 via the groove 66 in the side face of the valve stem. The valve stem has a finger grip knob 67 to facilitate moving the diverter valve from one position to the other. Of course, it is contemplated that the finger grip knob may comprise any manual means for rotating the diverter valve such as groove, tab, or the like. The valve stem is retained in the cylindrical body by an 'O'-ring seal 69 fitting into suitable grooves in the body and the valve stem.

A flexible extension may also be utilized with the embodiments described heretofore providing additional means for directing the stream of the contents of the container as shown in Figure wherein a tube 70 includes a straight portion 72 and a circumferentially grooved portion 74.

For instance, the extension comprising a tube or straw can be grooved circumferentially, one groove at a time, progressively part way toward one end of the straw, starting inwardly from the other end, the grooves having sides of unequal length for snapping over center in flexing or straightening the extension. Such an extension is taught in part in Harp et al. U.S. Pat. No. 3,409,224, and a machine for making same taught in U.S. Pat. No. 3,641,884, both or which are incorporated by reference herein. Each of the corrugations is defined by a circumferential groove having sides of unequal length, and these corrugations, when the straw is contracted lengthwise, defining reentrant overlapping folds. Each of these folds, in flexing the extension to a desired extent open with a "pop" as the fold goes past dead center, thereby holding the portion of the extension beyond the corrugations at any given set position.

When used with the dispenser cap and low viscosity fluids the applicator tube and corrugated sections may be of a selected small internal diameter. When used with a foam, gel, or expandable foam, the diameter of the applicator tube extension and corrugations may be sized accordingly, usually utilizing larger dimensions.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

What is claimed is:

1. An adjustable dispensing nozzle for an aerosol container comprising a cap having a top wall, an annular lower wall portion mountable on an aerosol container and a valve actuating lever portion for depressing a tubular valve stem on the aerosol container, said valve actuating portion lever having a passageway communicating at one end thereof with the passageway of said tubular valve stem and at the other end with a first socket in an outer face surface of said cap, a first elbow having a stem inserted into and rotatable in said first socket, a second elbow rotatable connected to said first elbow, said second elbow including a diverter valve and an extension tube connected to said second elbow;

said first and second elbows are pivotal about respective first and second axis and wherein said axes are perpendicular to one another;

said first elbow comprises a tubular member open at one end and closed at the other opposite end and wherein the stem of said first elbow projects from said tubular member;

said stem of said first elbow is perpendicular to said tubular member;

said second elbow has a stem projecting therefrom, wherein said open ended tubular member provides a second socket and wherein said second elbow stem projects into said second socket; and said stem on said second elbow has an annular groove communicating with a passage through said second elbow and wherein said groove is aligned with a flow passage in the stem in said first elbow.

2. The adjustable nozzle as defined in claim 1 wherein said second elbow has a stem projecting therefrom into said tubular member of said first elbow.

3. In an aerosol container having a valve operating and dispensing tube projecting upwardly therefrom, a cap mounted on said container and having a valve actuating lever portion attached thereto that engages said valve operating tube, said valve actuating lever portion having a passage therethrough communicating at one end thereof with the container valve dispensing tube and at the other end terminating in a first socket in an outer surface of said cap, a first elbow having a stem inserted into said first socket and rotatable therein, a second elbow further comprising means for pivotally connecting to said first elbow and means for cooperatively engaging an extension member extending from a distal end thereof, wherein the improvement comprises:

a diverter valve rotatably mounted within a cylindrical body portion of said first elbow including means for directing the contents of the container to said second elbow and said extension member or an orifice formed in said first elbow to exit as a spray to deliver the contents to a selected target;

said second elbow has a stem projecting therefrom, and said open ended tubular member provides a second socket, and said second elbow stem projects into said second socket;

said stem of said first elbow is perpendicular to said tubular member;

said first elbow comprises a tubular member open at one end and closed at the other opposite end and wherein the stem of said first elbow projects from said tubular member;

said first and second elbows are pivotal about respective first and second axis and wherein said axes are perpendicular to one another; and means for dispensing a spray from said first elbow comprising a stem on said second elbow having an annular groove communicating with a passage through said elbow and wherein said groove is aligned with a flow passage in said stem in said first elbow.

4. The adjustable nozzle as defined in claim 3 wherein said second elbow has a stem projecting therefrom into said tubular member of said first elbow.

* * * * *